US007963824B2

(12) United States Patent
Meunier et al.

(10) Patent No.: US 7,963,824 B2
(45) Date of Patent: Jun. 21, 2011

(54) METHOD OF GROOVING OR COUNTER-BEVELING THE PERIPHERY OF AN OPHTHALMIC LENS

(75) Inventors: Jean-Marc Meunier, Oissel (FR); Bruno Bizet, Alizay (FR)

(73) Assignee: Briot International, Pont de l'Arche (FR)

( * ) Notice: Subject to any disclaimer, the term of this patent is extended or adjusted under 35 U.S.C. 154(b) by 0 days.

(21) Appl. No.: 11/579,912

(22) PCT Filed: May 12, 2005

(86) PCT No.: PCT/FR2005/001190

§ 371 (c)(1),
(2), (4) Date: Nov. 8, 2006

(87) PCT Pub. No.: WO2005/123340

PCT Pub. Date: Dec. 29, 2005

(65) Prior Publication Data

US 2007/0224921 A1 Sep. 27, 2007

(30) Foreign Application Priority Data

May 18, 2004 (FR) ..... 04 05427

(51) Int. Cl.
*B24B 49/00* (2006.01)

(52) U.S. Cl. ..... 451/10; 451/11; 451/43

(58) Field of Classification Search ..... 451/5, 242, 451/9, 10, 11, 43, 44, 57, 58, 246, 255, 256
See application file for complete search history.

(56) References Cited

U.S. PATENT DOCUMENTS

| | | | | |
|---|---|---|---|---|
| 5,148,637 | A * | 9/1992 | Byron | 451/5 |
| 5,347,762 | A * | 9/1994 | Shibata et al. | 451/5 |
| 5,538,459 | A * | 7/1996 | Gottschald et al. | 451/11 |
| RE35,898 | E * | 9/1998 | Shibata et al. | 451/5 |
| 5,803,793 | A * | 9/1998 | Mizuno et al. | 451/5 |
| 6,241,577 | B1 * | 6/2001 | Shibata | 451/5 |
| 6,623,339 | B1 * | 9/2003 | Igarashi et al. | 451/42 |
| 7,281,967 | B2 * | 10/2007 | Meunier et al. | 451/5 |
| 7,463,944 | B2 * | 12/2008 | Schaeffer | 700/164 |
| 2003/0087583 | A1 * | 5/2003 | Shibata | 451/5 |
| 2003/0157211 | A1 * | 8/2003 | Tsunetomo et al. | 425/471 |
| 2004/0097168 | A1 * | 5/2004 | Igarashi et al. | 451/5 |
| 2006/0166605 | A1 * | 7/2006 | Hatano et al. | 451/5 |
| 2006/0217036 | A1 * | 9/2006 | Meunier et al. | 451/5 |
| 2006/0240747 | A1 * | 10/2006 | Natsume et al. | 451/5 |

FOREIGN PATENT DOCUMENTS

EP 1 310 326 5/2003

* cited by examiner

*Primary Examiner* — Eileen P. Morgan
(74) *Attorney, Agent, or Firm* — Wenderoth, Lind & Ponack, L.L.P.

(57) ABSTRACT

A method for grooving or counter-beveling the periphery of an opthamalic lens in a grinding machine is provided. The grinding machine includes a lens support with a mechanism configured to rotate the lens about a first axis, a grooving or counter-beveling wheel rotatable about a second axis which can be tilted relative to the first axis, and a mechanism to adjust the angle of tilt of the second axis relative to the first axis. Initially, a profile for the groove is determined. A single treatment angle corresponding to the profile is calculated, and the angle of tilt of the second axis is adjusted to the value of the single treatment angle. A groove or counter-bevel is ground into the periphery of the lens with the angle of tilt remaining constant throughout the grinding.

9 Claims, 3 Drawing Sheets

METHOD OF GROOVING OR COUNTER-BEVELING THE PERIPHERY OF AN OPHTHALMIC LENS

FIELD OF THE INVENTION

The present invention relates to a method of grooving or counter-beveling the periphery of an ophthalmic lens in a grinding machine, the machine comprising:

- a lens support provided with a mechanism configured to drive the lens in rotation about a first axis;
- a grooving or counter-beveling wheel mounted on a drive shaft rotatable about a second axis;
- a mechanism configured to relatively position the grooving or counter-beveling wheel along the first axis; and
- a mechanism to adjust the angle of tilt of the second axis relative to the first axis.

BACKGROUND OF THE INVENTION

EP 1 310 326 discloses a method of grooving in a machine of the above-specified type,
in which a determined grooving profile is selected for the periphery of an optical lens.

As a function of the profile, grooving is performed by modifying the angle of tilt of the grooving wheel for a large number of angular positions of the lens about its axis of rotation on the support (e.g. for about 500 positions).

Although a groove of substantially uniform width can be obtained for lenses that have a high degree of curvature and/or an angular shape (e.g. square or rectangular), such method is not entirely satisfactory. Due to the large number of angular positions of the lens about its axis of rotation, implementing the method requires a computer having considerable computation power and a mechanism that is both accurate and complex in order to adjust the angle of tilt of the grooving wheel dynamically relative to the first axis.

SUMMARY OF THE INVENTION

An object of the invention is to obtain a method of grooving or counter-beveling the periphery of an ophthalmic lens that makes it possible to obtain a groove or counter-bevel of satisfactory appearance and a groove, with a depth that is satisfactory to effectively retain a thread for mounting the lens in its frame, the method being simple to implement.

To this end, the invention provides a method of the above-specified type, the method being characterized in that it comprises the following steps:

- determining a profile for a groove or a counter-bevel;
- calculating a single treatment angle corresponding to said profile;
- adjusting the angle of tilt of the second axis relative to the first axis to the value of the single treatment angle; and
- grinding the groove or the counter-bevel in the lens while maintaining said angle of tilt constant.

The method of the invention may include one or more of the following characteristics taken in isolation or in any technically feasible combination:

- the single treatment angle is calculated as an increasing function of the mean base of the profile of the groove or counter-bevel;
- the single treatment angle is calculated as an increasing function of the mean radius of curvature of the profile of the groove or the counter-bevel;

- the single treatment angle is calculated as an increasing function of the product of the mean base multiplied by the mean radius of curvature; and
- the single treatment angle is calculated using the formula:

$$\alpha_0 = \arccos\left(1 - \frac{f_{moy} \times \delta_{moy}}{530}\right)$$

where:

$\alpha_0$ is the single treatment angle;

$f_{mean}$ is the mean sagitta of the profile of the groove or of the counter-bevel; and $\delta_{mean}$ is the mean base of the profile of the groove or of the counter-bevel.

BRIEF DESCRIPTION OF THE DRAWINGS

An embodiment of the invention is described below with reference to the accompanying drawings, in which.

DETAILED DESCRIPTION OF THE PREFERRED EMBODIMENTS

Figure 1:
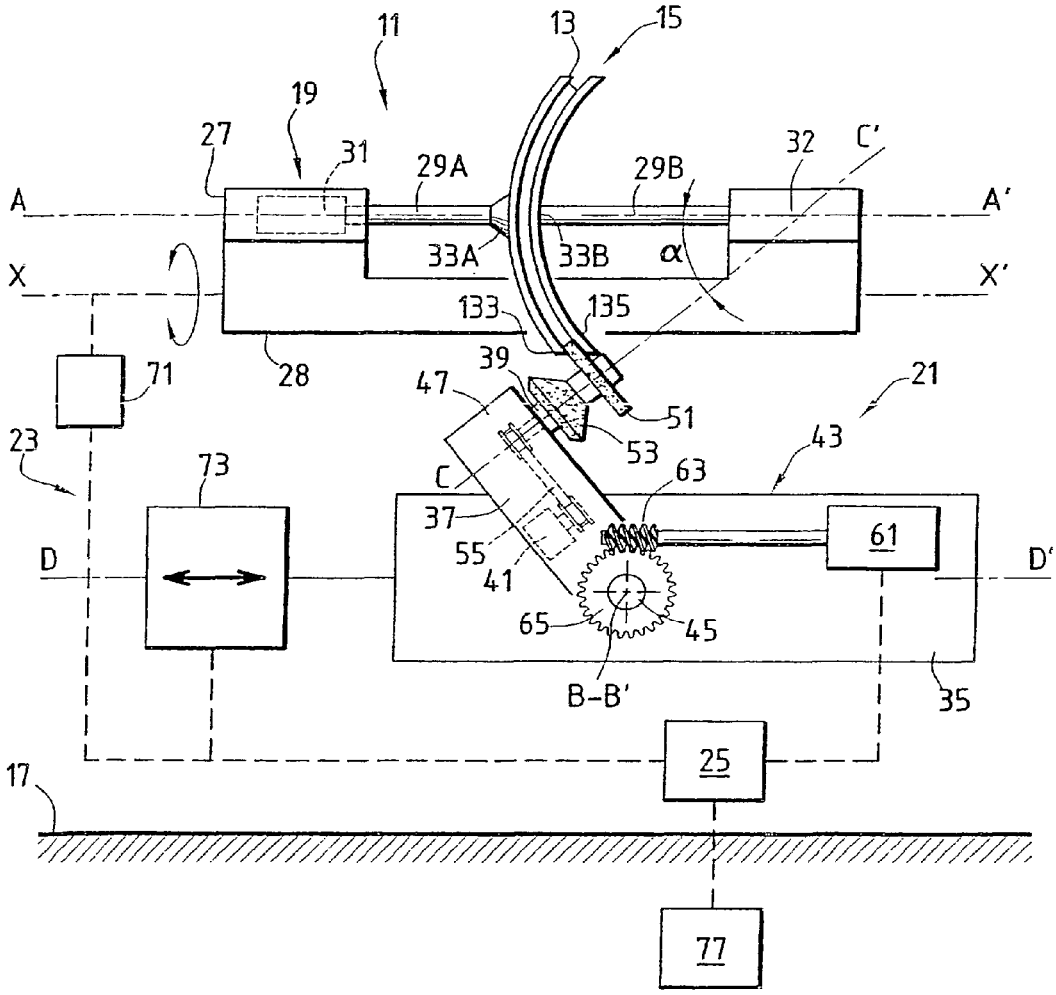
FIG. 1 is a fragmentary diagrammatic view in elevation of pertinent portions of a grinding machine for implementing the method of the invention.

The grinding machine 11 shown in FIG. 1 is for treating or machining the periphery 13 of an ophthalmic lens 15 in order to perform grooving and/or counter-beveling operations therein. The lens 15 is initially blanked out by peripheral grinding.

The machine 11 comprises a stand 17, a lens support 19, a tool carrier assembly 21, a mechanism 23 configured to position the assembly 21 axially and radially relative to the support 19, and a control unit 25.

The lens support 19 comprises a carriage 27 mounted to rock relative to the stand 17. The carriage has two half-shafts 29A, 29B suitable for holding the lens 15, and a motor 31 for rotating the lens 15.

The carriage 27 is hinged relative to the stand 17 via a rear longitudinal edge 28 about a rocking axis X-X' that is substantially horizontal.

The two half-shafts 29A, 29B are mounted along the front longitudinal edge 32 of the carriage 27. These half-shafts 29A, 29B extend along a first axis A-A' that is substantially horizontal and parallel to the axis X-X'.

The half-shafts 29A, 29B have free ends 33A, 33B, respectively, which are disposed facing each other and adapted to take hold of the lens 15.

The motor 31 for driving the lens 15 rotates the half-shafts 29A, 29B about the first axis A-A' via a transmission mechanism (not shown).

As shown in FIG. 1, the tool carrier assembly 21 comprises a support 35, a connection arm 37 projecting from the support 35, a tool carrier shaft 39, a motor 41 for driving the tool carrier shaft 39 in rotation, and a mechanism 43 configured to tilt the tool carrier shaft 39 relative to the support 35.

The connection arm 37 is hinged at a first end 45 to the support 35 about a horizontal pivot axis B-B' that is substantially orthogonal to the first axis A-A'.

The tool carrier shaft 39 is rotatably mounted at the free end 47 of the connection arm about a second axis C-C' that is substantially orthogonal to the connection arm 37.

The shaft 39 carries a grooving wheel 51 and a counter-beveling wheel 53.

In an alternate embodiment, the tool carrier shaft 39 could also carry a drilling tool at its free end that extends along the axis C-C'.

The grooving wheel 51 is a thin cylindrical disk. In the embodiment shown in FIG. 1, the thickness of this disk is substantially constant and lies in the range 0.5 millimeters (mm) to 1.6 mm.

The counter-beveling wheel 53 presents on its outside a cylindrical middle surface between two frustoconical surfaces both of which taper going away from the middle surface.

The arm 37, and consequently the tool carrier shaft 39, can be pivoted about the axis B-B' over an angle of at least 30°. Preferably, the arm and tool carrier shaft pivot 180° about axis B-B', moving between a top vertical position in which the second axis C-C' is substantially parallel to the first axis A-A', and a plurality of tilted positions in which the second axis C-C' is tilted relative to the first axis A-A'.

In the embodiment shown in FIG. 1, the tool carrier shaft 39 remains substantially in the vertical plane containing the first axis A-A', irrespective of its position about the axis B-B'.

The motor 41 for rotating the tool carrier shaft 39 is secured to the connection arm 37 and connected to the shaft 39 by transmission means 55 disposed in the connection arm 37.

The mechanism 43 configured to adjust the tilt angle of the tool carrier shaft 39 comprises a motor 61 for driving a wormscrew 63 and a tangential gearwheel 65 secured to the connection arm 37. The wormscrew 63 extends in a direction that is substantially parallel to the first axis A-A'.

The gearwheel 65 is secured to the free end 45 of arm 37 and lies in a plane that is substantially parallel to the plane defined by the first axis A-A' and the second axis C-C'.

The mechanism 23 to position the tool carrier assembly 21 axially and radially relative to the lens support 19 may comprise, for example, a mechanism 71 to rock the carriage 27 about its rocking axis X-X' and a mechanism 73 to move the tool carrier assembly 21 in axial translation along an axis D-D', which is parallel to the first axis A-A'.

The control unit 25 controls firstly displacement of the tool carrier assembly 21 along the axis D-D' and secondly displacement of the carriage 19 about the axis X-X'. This movement can be considered as pseudo-translation along an axis perpendicular to the first axis A-A'.

The control unit 25 also servo-controls the mechanism 23 to position the wheels 51 and 53 selectively in contact with the periphery 13 of the lens 15.

The control unit 25 is connected to the motor 61 of the tilt mechanism 43 to cause the wormscrew 63 to rotate in a first direction or in the direction opposite to the first direction to adjust the angle of tilt of the second axis C-C' relative to the first axis A-A'.

The control unit 25 is connected to a computer 77 for calculating a single angle of tilt for grooving or counter-beveling, in the manner described below.

An example of the grooving method of the invention is described below with reference to FIGS. 2 and 3.

The method comprises a step 101 of selecting the groove profile, a step 103 of calculating a single treatment angle corresponding to said groove profile, a step 105 of adjusting the angle of tilt of the grooving wheel relative to the blanked-out lens, and a step 107 of grinding the groove.

Initially, as shown in FIG. 1, a blanked-out lens 15, which presents its final outline, is secured between the two ends 33A, 33B of the two half-shafts 29A, 29B by means of an adapter suitably positioned on said lens 15.

Figure 2:
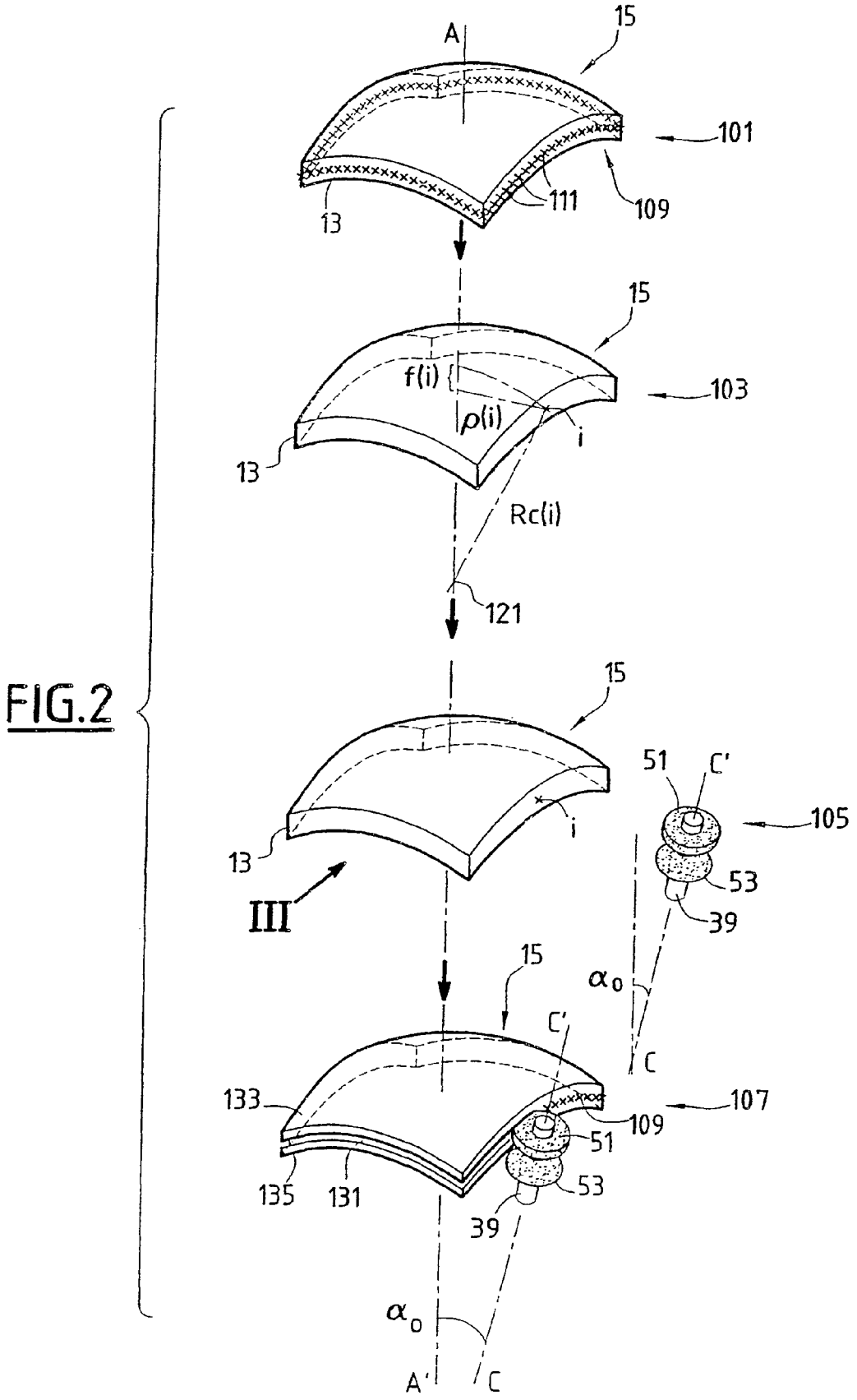
FIG. 2 is a diagrammatic perspective view of a lens during the various steps of the method of the invention.

With reference to FIG. 2, in step 101, an optician determines a groove profile 109 by selecting the position of the groove on the periphery 13 for a number of points 111 selected around the axis A-A' of the lens 15. Each point 111 corresponds to an angular position of the lens 15 about the first axis A-A'.

By way of example, the number of points 111 is in the range 128 to 1024, but preferably 512.

The profile 109 of the groove depends in particular on the shape of the lens and of the frame selected for the lens. This profile 109 is substantially inscribed on a sphere of center 121.

In calculation step 103, the computer 77 calculates a single treatment angle $\alpha_0$ as an increasing function of the mean radius of curvature $R_{cmean}$ of the profile 109.

For this purpose, the computer 77 advantageously determines the mean rise or "sagitta" $f_{mean}$ of the profile 109 by the formula:

$$f_{mean} = \frac{\sum_{i=0}^{N} f(i)}{N} \tag{1}$$

in which f(i) is the sagitta of the profile 109 at the point i corresponding to a given angular position of the lens 15, and N is the number of selected points 111 defining the profile 109.

Figure 3:
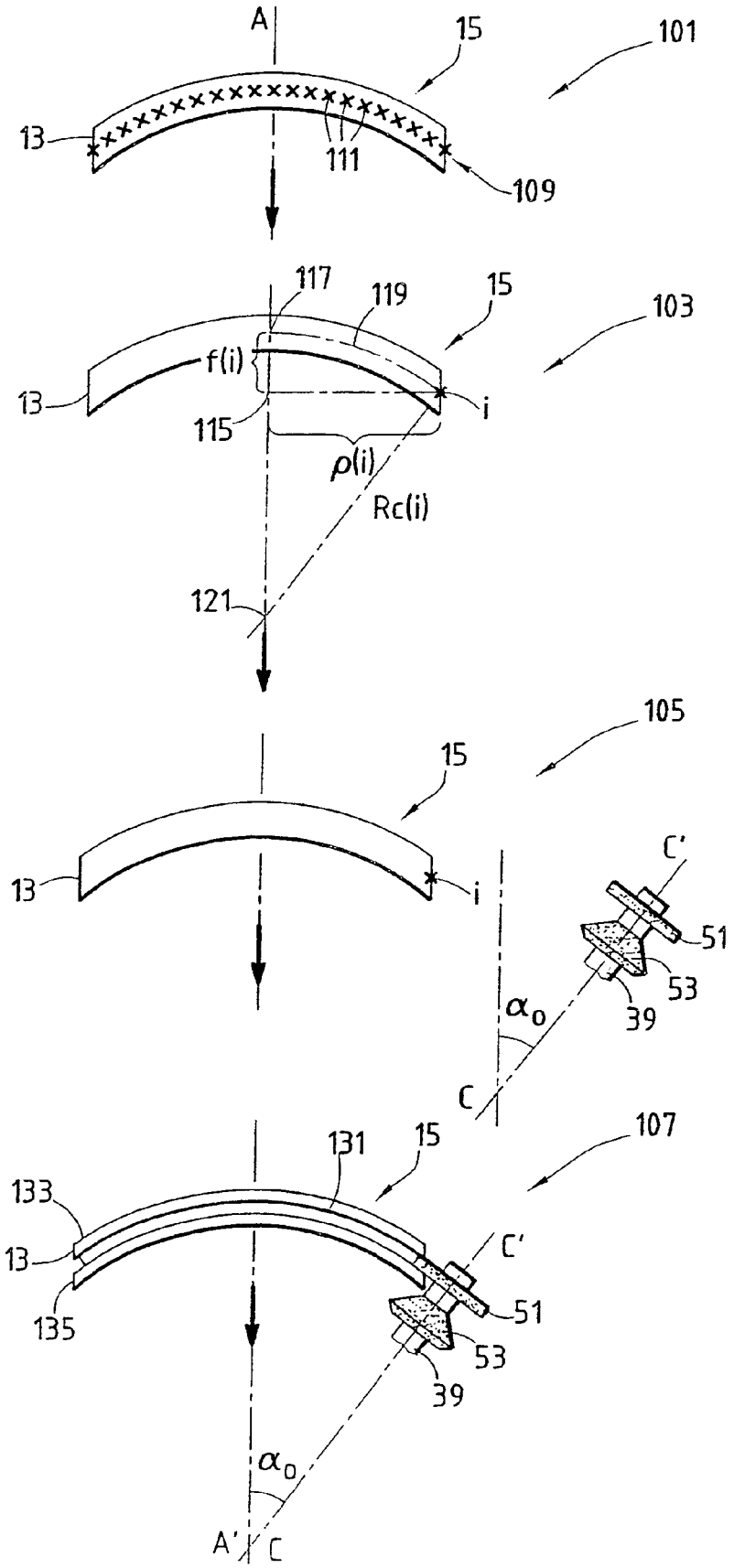
FIG. 3 is a side view of FIG. 2 seen looking along arrow III.

The sagitta f(i) is calculated, as shown in FIG. 3, by the distance between firstly the orthogonal projection 115 of the point i on the axis A-A' of the lens, and secondly the point of intersection 117 of the axis A-A' and the sphere 119 that passes through the point i and that is centered on the above-mentioned center 121.

The radius of curvature $R_c(i)$ depends on the sagitta f(i) as follows:

$$R_c(i) = \frac{(\rho(i)^2 + f(i)^2)}{2f(i)} \tag{2}$$

where ρ(i) is the distance between the point i and the axis A-A', measured orthogonally to said axis A-A'.

Preferably, the single treatment angle $\alpha_0$ is also calculated as an increasing function of the mean base $\delta_{mean}$ of the profile 109. The mean base $\delta_{mean}$ is calculated using the formula:

$$\delta_{mean} = \frac{\sum_{i=0}^{N} \left( \frac{530 \times 2f(i)}{\rho(i)^2 + f(i)^2} \right)}{N} \tag{3}$$

Advantageously, the single treatment angle $\alpha_0$ is an increasing function of the product of the mean base $\delta_{mean}$ multiplied by the mean radius of curvature $R_{cmean}$.

Advantageously, the single treatment angle $\alpha_0$ is calculated using the following formula:

$$\alpha_0 = \arccos\left(1 - \frac{f_{mean} \times \delta_{mean}}{530}\right) \quad (4)$$

In the adjustment step 105, the motor 61 is actuated to rotate the wormscrew 63, and consequently to tilt the support arm 37 until the angle $\alpha$ formed by the first axis A-A' and the second axis C-C' is equal to the single treatment angle $\alpha_0$.

During the grinding step 107, the grooving wheel 51 is brought into contact with the periphery 13 of the lens 15 by mechanism 23. The motor 31 for rotating the lens 15 is then actuated and a groove 131 is formed in the periphery 13 of the lens 15 along the profile 109.

Throughout the grooving step, the angle of tilt of the second axis C-C' relative to the first axis A-A' is kept constant and equal to the single treatment angle $\alpha_0$, regardless of the angular position of the lens 15 about the first axis A-A'.

The treatment angles $\alpha_0$ as calculated by formula (4) make it possible for each lens 15 under consideration to obtain a groove 131 that presents an appearance and a depth sufficient to securely hold a thread for mounting the lens in its frame.

Calculation shows that the treatment angle $\alpha_0$ is an increasing function of the mean base $\delta_{mean}$ of the profile 109 and of the mean sagitta $f_{mean}$ of said profile 109.

The angle $\alpha_0$ thus preferably lies in the range 0° to 30°.

Since the angle of tilt a of the second axis C-C' relative to the first axis A-A' is kept constant throughout the grooving step 107, the mechanism 43 to adjust this angle of tilt $\alpha$ is simplified.

In a variant of the method, the wheel used is the counter-beveling wheel 53. The determined profile of the counter-bevel is determined by the outline of the peripheral edges 133 and 135 of the lens. This wheel 53 is applied successively against the front edge 133, then against the rear edge 135 of the lens 15 while maintaining, for each edge 133 and 135, the angle $\alpha$ formed by the first axis A-A' and the second axis C-C' constant and equal to the single treatment angle $\alpha_0$.

In another variant (not shown), the grinding machine 11 further includes a set of wheels, e.g. comprising a blanking wheel, a beveled finishing wheel, and a beveled polishing wheel, as described in French patent application No. 03/03792.

The method further includes a step of blanking-out the lens, prior to grinding the groove or the counter-bevel.

The method of the invention does not require a computer that has high calculation power, nor does it require complex means for controlling the tilt angle of the grooving wheel 51 or the counter-beveling wheel 53 relative to the lens 15.

The invention claimed is:

1. A method of grooving or counter-beveling the periphery of an ophthalmic lens in a grinding machine, the machine comprising:

a lens support provided with a mechanism configured to drive the lens in rotation about a first axis;

a grooving or counter-beveling wheel mounted on a drive shaft and rotatable about a second axis;

a mechanism configured to relatively position the grooving or counter-beveling wheel along the first axis; and a mechanism configured to adjust an angle of tilt of the second axis relative to the first axis;

the method comprising:

determining a profile for a groove or a counter-bevel;

calculating a single treatment angle corresponding to said profile;

adjusting the angle of tilt of the second axis relative to the first axis to the value of the single treatment angle; and grinding the groove or the counter-bevel in the lens by rotating the lens about the first axis, such that a width of the groove or the counter-bevel is constant, while maintaining said angle of tilt constant and equal to the value of the single treatment angle at all rotational positions of the lens as the lens is rotated about the first axis.

2. A method according to claim 1, wherein the single treatment angle is calculated as an increasing function of a mean base of the profile of the groove or counter-bevel.

3. A method according to claim 1, wherein the single treatment angle is calculated as an increasing function of a mean radius of curvature of the profile of the groove or the counter-bevel.

4. A method according to claim 2, wherein the single treatment angle is calculated as an increasing function of a mean radius of curvature of the profile of the groove or the counter-bevel.

5. A method according to claim 4, wherein the single treatment angle is calculated as an increasing function of the mean base of the profile of the groove or counter-bevel, and wherein the single treatment angle is calculated as an increasing function of the product of said mean base multiplied by said mean radius of curvature.

6. A method according to claim 5, wherein the single treatment angle is calculated using the formula:

$$\alpha_0 = \arccos\left(1 - \frac{f_{mean} \times \delta_{mean}}{530}\right)$$

where:

$\alpha_0$ is the single treatment angle;

$f_{mean}$ is a mean sagitta of the profile of the groove or of the counter-bevel; and $\delta_{mean}$ is a mean base of the profile of the groove or of the counter-bevel.

7. A method according to claim 1, wherein said grinding of the groove or counter-bevel comprises grinding of the groove or counter-bevel about an entirety of the periphery of the lens and maintaining the angle of tilt of the second axis relative to the first axis equal to the value of the single treatment angle throughout the grinding of the groove or counter-bevel about the entirety of the periphery of the lens.

8. A method according to claim 1, wherein said adjusting the angle of tilt of the second axis relative to the first axis involves pivoting the drive shaft about a pivot axis.

9. A method according to claim 1, wherein said grinding of the groove or the counter-bevel comprises grinding the groove in the lens with the grooving wheel.

* * * * *